US008425001B2

(12) United States Patent
Hirasawa

(10) Patent No.: US 8,425,001 B2
(45) Date of Patent: Apr. 23, 2013

(54) FLUID EJECTING APPARATUS, METHOD OF MAINTAINING FLUID EJECTING APPARATUS, AND METHOD OF DRIVING TUBE PUMP

(75) Inventor: Yusuke Hirasawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 233 days.

(21) Appl. No.: 13/024,725

(22) Filed: Feb. 10, 2011

(65) Prior Publication Data

US 2011/0199428 A1 Aug. 18, 2011

(30) Foreign Application Priority Data

Feb. 12, 2010 (JP) ..... 2010-028878

(51) Int. Cl.
*B41J 2/165* (2006.01)

(52) U.S. Cl.
USPC ..... 347/29

(58) Field of Classification Search ..... 347/29, 347/30, 34, 31–33
See application file for complete search history.

(56) References Cited

U.S. PATENT DOCUMENTS

| | | | | |
|---|---|---|---|---|
| 7,318,638 | B2 | 1/2008 | Shimizu et al. | |
| 7,357,478 | B2 * | 4/2008 | Usuda et al. | 347/29 |
| 7,625,080 | B2 * | 12/2009 | Hess et al. | 347/92 |
| 7,735,957 | B2 * | 6/2010 | Kudo et al. | 347/30 |

FOREIGN PATENT DOCUMENTS

| | | |
|---|---|---|
| JP | 2009-051226 | 3/2009 |

* cited by examiner

*Primary Examiner* — Lamson Nguyen

(57) ABSTRACT

When a real absorption operation is performed many times as one maintenance operation, a starting position of a roller member when performing a real absorption operation is adjusted by performing an idle absorption operation on at least one side before and after each real absorption operation.

10 Claims, 8 Drawing Sheets

FLUID EJECTING APPARATUS, METHOD OF MAINTAINING FLUID EJECTING APPARATUS, AND METHOD OF DRIVING TUBE PUMP

CROSS-REFERENCE TO RELATED APPLICATION

Japanese Patent Application No. 2010-028878 filed Feb. 12, 2010, is hereby incorporated by reference in its entirety.

BACKGROUND

1. Technical Field

The present invention relates to a fluid ejecting apparatus, a method of maintaining the fluid ejecting apparatus, and a method of driving a tube pump.

2. Related Art

As a liquid ejecting apparatus ejecting liquid, for example, an ink jet printing apparatus, which prints characters and images on a printing medium, and the like are known. The ink jet printing apparatus ejects ink from nozzles provided in an ejection head onto a printing medium while transporting the printing medium, to form characters or images on the printing medium. The ink jet printing apparatus is provided with a cap covering an ejection area of the ejection head.

In the ink jet printing apparatus, clogging may occur on the nozzles of the ejection head by thickening or solidification of ink, attachment of dust, mixing of bubbles, and the like, thereby causing a fault in printing. When ink is initially charged in the ejection head, it is necessary to discharge liquid in the head from the nozzles. For this reason, a maintenance operation such as a cleaning operation of compulsorily discharging the liquid in the nozzles is performed separately from the ejection onto the printing medium.

In the cleaning operation, the liquid discharged from the ejection head is received using a liquid receiving portion such as a cap portion. The cap portion is provided with, for example, an outlet for allowing the received ink to flow out. The outlet is connected to an absorption mechanism such as a tube pump.

The tube pump has a tube member connected to the cap portion and having a curved portion with flexibility, and a roller member rolling in an inner circumference of the curved portion while pressing and deforming the tube member, and pressure of a space at the cap portion is changed by the rolling of the roller member.

The tube pump has a configuration in which the amount of absorption is changed by a starting position of the roller member. Particularly, when including a leak portion in which the amount of deformation caused by the pressing of the roller member is insufficient and a set value of the amount of absorption (rotation) is small, the starting position of the roller member is changed to cause non-uniformity in the actual amount of absorption, which is a problem.

For example, a tube pump described in JP-A-2009-51226 detects a phase of a rolling operation of the roller member using phase detecting means to stop the roller member at a predetermined position on the basis of the detection result. Accordingly, it is possible to suppress the non-uniformity in the amount of absorption for each cleaning operation.

However, in the technique of JP-A-2009-51226, it is necessary to separately provide the phase detection means, and thus there is a problem that the configuration of the tube pump is slightly complex.

SUMMARY

An advantage of some aspects of the invention is to provide a fluid ejecting apparatus, a method of maintaining the fluid ejecting apparatus, and a method of driving a tube pump, capable of suppressing the non-uniformity in the amount of absorption for each maintenance operation without making the configuration of the apparatus complex.

According to an aspect of the invention, there is provided a fluid ejecting apparatus including: an ejection head that has an ejection face to eject fluid; a cap portion that covers the ejection face of the ejection head; a tube pump that includes a tube member connected to the cap portion and having a curved portion with flexibility and a roller member rolling in an inner circumference of the curved portion while pressing and deforming the tube member, to change pressure of a space at the cap portion by the rolling of the roller member; and a control device that performs an absorption operation including a real absorption operation of rolling the roller member in a state where the cap portion covers the ejection face and an idle absorption operation of rolling the roller member in a state where the cap portion does not cover the ejection face, to maintain the ejection head, wherein the control device adjusts a starting position of the roller member when performing the real absorption operation by performing the idle absorption operation on at least one side before and after each real absorption operation, when the real absorption operation is performed many times as one maintenance operation.

According to the aspect of the invention, when the real absorption operation is performed many times as one maintenance operation, the idle absorption operation is performed on at least one side before and after each real absorption operation to adjust the starting position of the roller member when performing the real absorption operation, and thus it is possible to adjust the starting position of the roller member without detecting the phase of the roller member. Accordingly, it is possible to suppress non-uniformity of the amount of absorption for each maintenance operation.

In the fluid ejecting apparatus, it is preferable that the control device shifts the starting position in a rolling direction of the roller member by the same angle whenever the real absorption operation is performed.

According to the aspect of the invention, since the starting position is shifted by the same angle whenever the real absorption operation is performed, it is possible to disperse the starting position of the roller member to the whole curved portion of the tube member. Accordingly, the non-uniformity of the amount of absorption hardly occurs during one whole maintenance operation.

In the fluid ejecting apparatus, it is preferable that the control device rolls the roller member in the same rolling direction in the real absorption operation and the idle absorption operation.

According to the aspect of the invention, since the roller member is rolled in the same rolling direction in the real absorption operation and the idle absorption operation, it is easy to adjust the starting position of the roller member.

In the fluid ejecting apparatus, it is preferable that the control device allows a position of the roller member when the last absorption operation in the one maintenance operation is completed, to coincide with the starting position of the first absorption operation in the one maintenance operation.

According to the aspect of the invention, since the roller member is returned to the initial position when one maintenance operation is completed, the position of the roller member can be made regular when the maintenance operation is started. Accordingly, it is possible to suppress the non-uniformity of the amount of absorption between the maintenance operations.

In the fluid ejecting apparatus, it is preferable that the curved portion include a leak portion in which the amount of deformation caused by the pressing of the roller member is insufficient.

According to the aspect of the invention, even when the tube pump including the leak portion is used, it is possible to suppress the non-uniformity of the amount of absorption for each maintenance operation. As a specific example of the tube pump including the leak portion, for example, there is a configuration (an omega type) of taking out both ends of a flexible tube cured in a ring shape in the same direction and controlling both ends on the same plane, or a configuration (an alpha type) of taking out tubes cured in a ring shape in a reverse direction to each other and intersecting the tubes with each other. In the omega type, the leak portion is included in a part where both ends of the tube can be bound, and in the alpha type, the leak portion is included in a part where the tubes intersect with each other.

According to still another aspect of the invention, there is provided a method of maintaining a fluid ejecting apparatus including an ejection head that has an ejection face to eject fluid; a cap portion that covers the ejection face of the ejection head; and a tube pump that includes a tube member connected to the cap portion and having a curved portion with flexibility and a roller member rolling in an inner circumference while pressing and deforming the tube member, to change pressure of a space at the cap portion by the rolling of the roller member, wherein as one maintenance operation, when a real absorption operation of rolling the roller member is performed many times in a state where the cap portion covers the ejection face, a starting position of the roller member when performing the real absorption operation is adjusted by performing an idle absorption operation of rolling the roller member in a state where the cap portion does not cover the ejection face on at least one side before and after each real absorption operation.

According to the aspect of the invention, when the real absorption operation is performed many times as one maintenance operation, the idle absorption operation is performed on at least one side before and after each real absorption operation to adjust the starting position of the roller member when performing the real absorption operation, and thus it is possible to adjust the starting position of the roller member without detecting the phase of the roller member. Accordingly, it is possible to suppress non-uniformity of the amount of absorption for each maintenance operation without complex of the configuration of the apparatus.

In the method of maintaining the fluid ejecting apparatus, it is preferable that the maintenance operation includes a cleaning operation of the ejection head.

According to the aspect of the invention, since the non-uniformity of the amount of absorption is suppressed for the cleaning operation of the ejecting head, it is possible to maintain expected ejection characteristics.

According to still another aspect of the invention, there is provided a method of driving a tube pump that includes a tube member that is connected to a cap portion covering an ejection face of an ejecting head ejecting fluid and has a curved portion with flexibility and a roller member rolling in an inner circumference of the curved portion while pressing and deforming the tube member, to change pressure of a space at the cap portion by the rolling of the roller member, wherein, as one maintenance operation for the ejection head, when a real absorption operation of rolling the roller member is performed many times in a state where the cap portion covers the ejection face, a starting position of the roller member when performing the real absorption operation is adjusted by performing an idle absorption operation of rolling the roller member in a state where the cap portion does not cover the ejection face on at least one side before and after each real absorption operation.

According to the aspect of the invention, when the real absorption operation is performed many times as one maintenance operation for the ejection head, the idle absorption operation is performed on at least one side before and after each real absorption operation to adjust the starting position of the roller member when performing the real absorption operation, and thus it is possible to adjust the starting position of the roller member without detecting the phase of the roller member. Accordingly, it is possible to suppress non-uniformity of the amount of absorption for each maintenance operation. Therefore, it is possible to maintain expected ejection characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printing apparatus as an embodiment of a liquid ejecting apparatus according to the invention will be described with reference to the drawings.

The ink jet printing apparatus IJ according to the invention is provided with an ink jet printing head (an example of the liquid ejecting head) in which pressure of ink in pressure chambers is changed by pressure generating elements provided corresponding to the pressure chambers communicating with a plurality of nozzle passages, and ink droplets (liquid droplets) are ejected from the nozzle passages. For example, a piezoelectric vibrator may be used as the pressure generating element.

Figure 1:
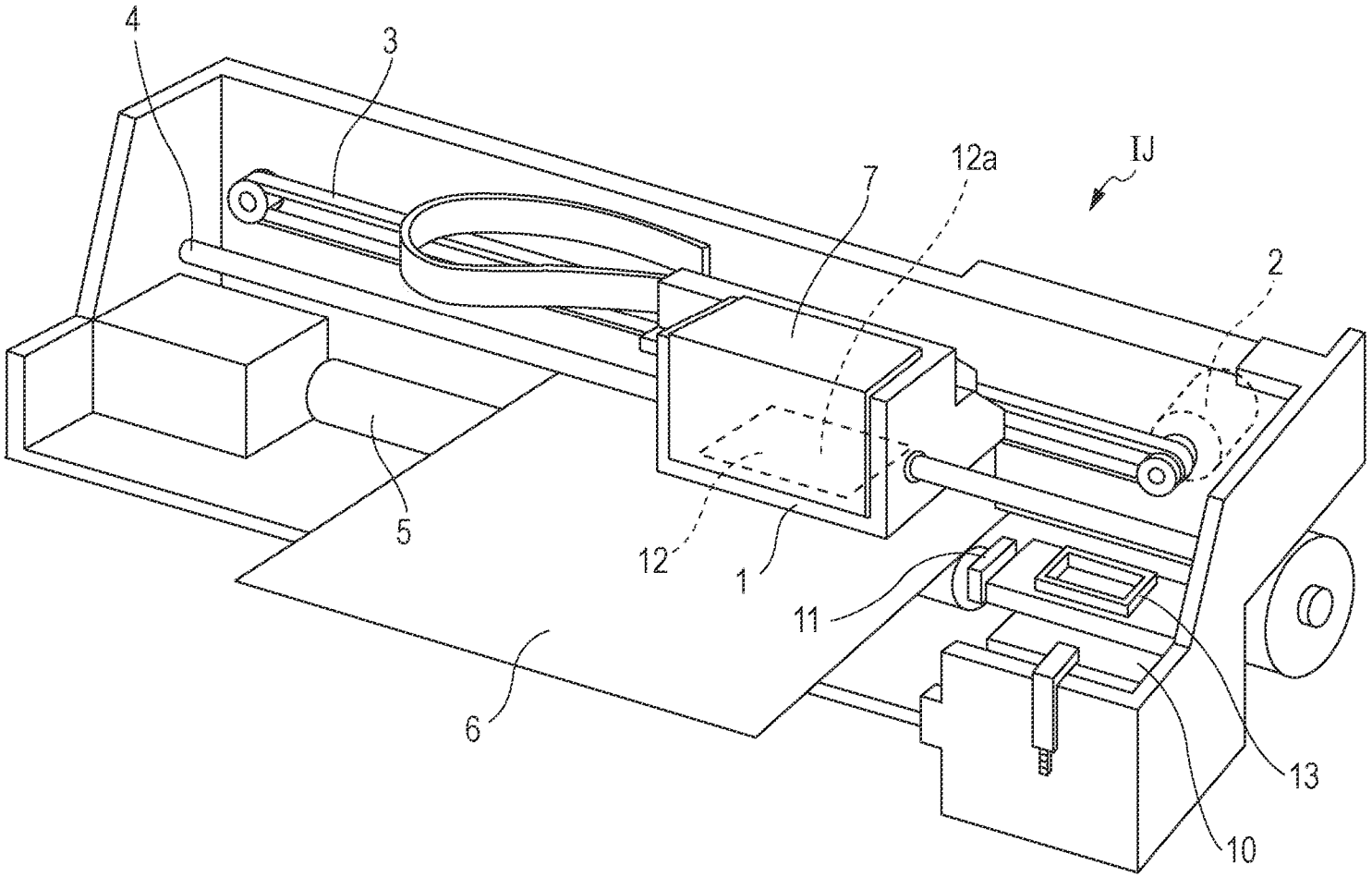
FIG. 1 is a perspective view illustrating a schematic configuration of an ink jet printing apparatus according to an embodiment of the invention.

FIG. 1 is a perspective view illustrating a schematic configuration of the ink jet printing apparatus IJ according to the embodiment. Reference Numeral 1 in FIG. 1 denotes a carriage, the carriage 1 is guided to a guide member 4 through a timing belt 3 driven by a carriage motor 2, and is reciprocally moved in an axial direction of a platen 5. The platen 5 supports a printing sheet 6 (an example of a printing medium) from a back face thereof, and regulates a position of the printing sheet 6 with respect to a printing head 12.

The printing head 12 is mounted on the side opposed to the printing sheet 6 of the carriage 1. An ink cartridge 7 supplying ink to the printing head 12 is attachably and detachably mounted on the carriage 1.

Figure 2:
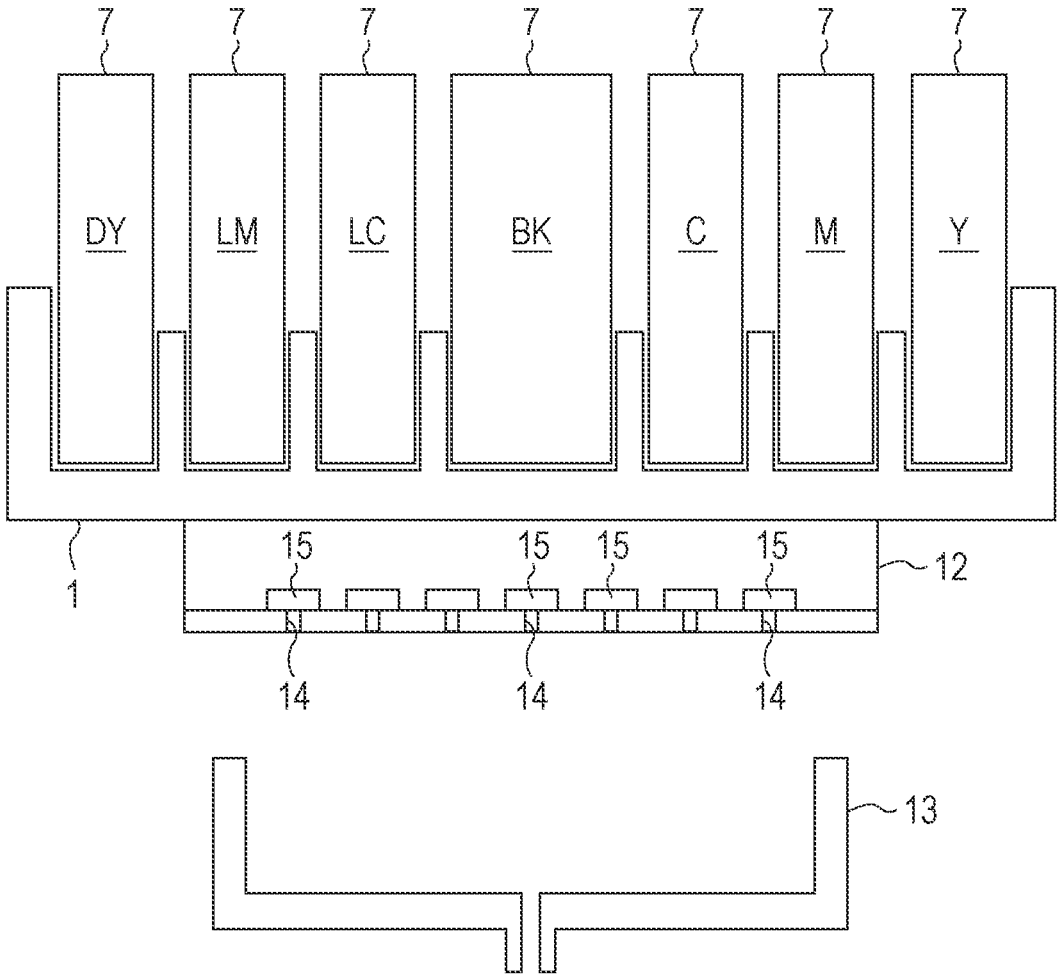
FIG. 2 is an enlarged view of a main part of the ink jet printing apparatus according to the embodiment.

As shown in FIG. 2, the printing head 12 is provided with a plurality of nozzle passages 14 and a plurality of pressure chambers 15 communicating with the nozzle passages 14, and the pressure of ink in the pressure chamber 15 is changed to eject ink droplets from the nozzle passages 14.

As shown in FIG. 1, a capping portion 13 is provided at a home position (the right side in FIG. 1) that is a non-printing area of the ink jet printing apparatus IJ. The capping portion 13 rises from a position shown in FIG. 2 when the printing head 12 mounted on the carriage 1 is moved to the home position to be pressed against a nozzle formed face 12*a* of the printing head 12, to form an airtight space with respect to the nozzle formed face 12*a*. A tube pump 10 applying negative pressure to the airtight space formed by the capping portion 13 to absorb ink is provided under the capping portion 13. An air opening mechanism (not shown) may be provided at a position different from the tube pump 10 under the capping portion 13.

In the vicinity of the printing area side of the capping portion 13, a wiping portion 11 provided with an elastic plate such as rubber is provided to advance and retreat, for example, in a horizontal direction with respect to a movement trace of the printing head 12. The wiping portion 11 sweeps the nozzle formed face 12*a* of the printing head 12 as necessary when the carriage 1 is moved on the capping portion 13.

The ink jet printing apparatus IJ further includes a sheet transport mechanism intermittently transporting the printing sheet 6 for printing by the printing head 12 in a sheet transport direction perpendicular to a head scanning direction.

Figure 3:
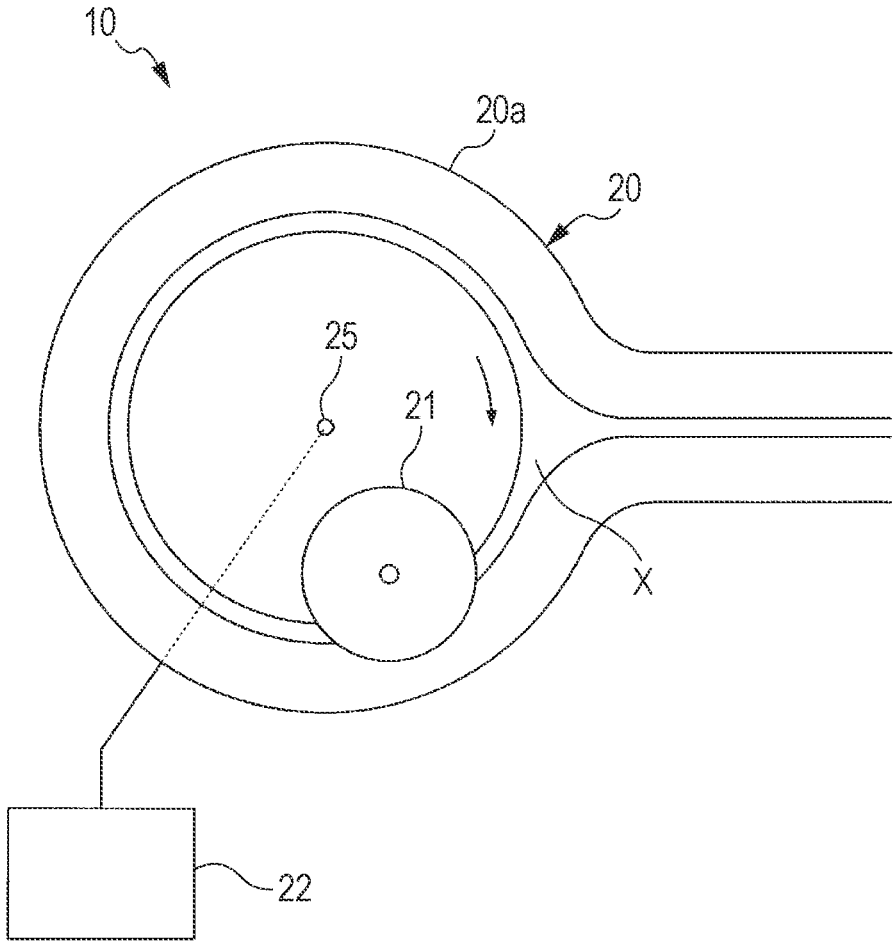
FIG. 3 is a view illustrating an inner structure of a tube pump according to the embodiment.

FIG. 3 shows an inner structure of the tube pump 10. As shown in FIG. 3, the tube pump 10 is of a type in which both ends of a flexible tube curved in a ring shape in the same direction are taken out to bundle both ends on the same plane. The tube pump 10 includes a tube member 20 including a ring-shaped portion 20*a*, a roller member 21 rolling in an inner circumference of the ring-shaped portion 20*a* of the tube member 20, a rotation plate 25 rotatably supporting the roller member 21 and rotating around a rotation shaft 25*a*, and a motor (a driving source) 22 rotating the rotation plate 25 to cause revolution of the roller member 21 to roll the roller member 21 along the inner circumference of the ring-shaped portion 20*a* of the tube member 20. The motor 22 may be also used as a motor of the sheet transport mechanism. The tube pump 10 includes a leak point X at which the amount of pressing deformation caused by the roller member 21 is insufficient, at a part where the tube member 20 can be bound.

Figure 4:
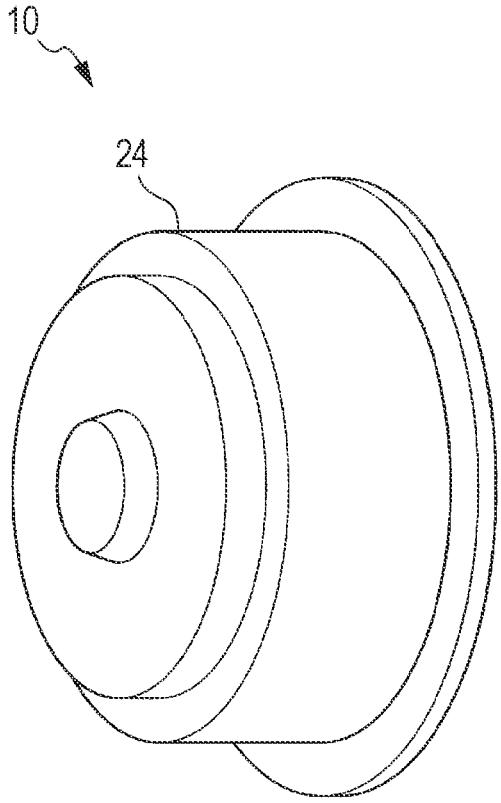
FIG. 4 is a perspective view illustrating an overview of the tube pump according to the embodiment.

FIG. 4 is a perspective view illustrating an overview of the tube pump 10 in the embodiment. In FIG. 4, Reference Numeral 24 denotes a pump frame. The ring-shaped portion 20*a* of the tube member 20 shown in FIG. 3 is housed in the pump frame 24. That is, a support face regulating an external shape of the flexible tube member 20 to the ring shape is formed on the inner face of the pump frame 24.

Figure 5:
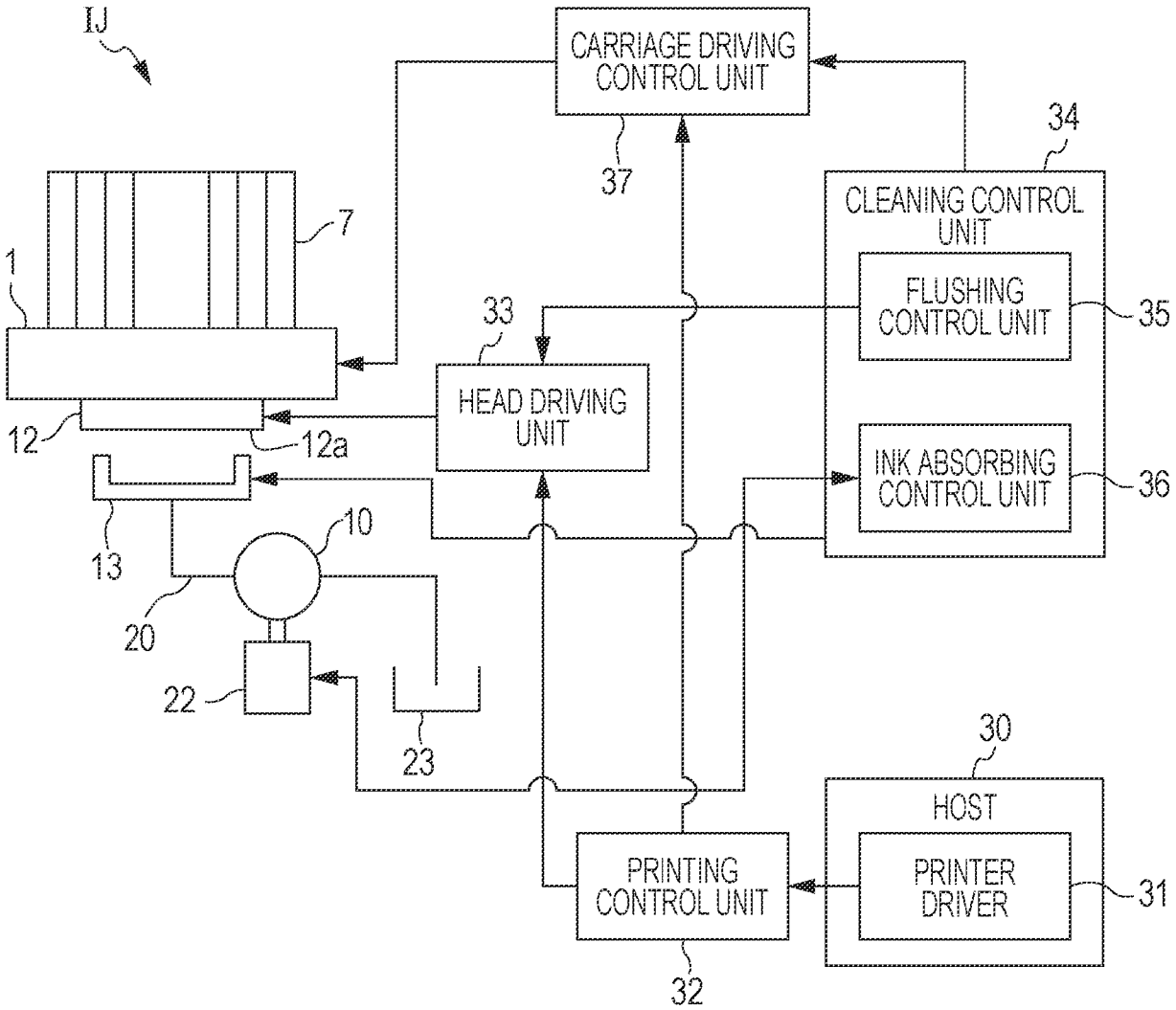
FIG. 5 is a block diagram schematically illustrating a control system of the ink jet printing apparatus.

FIG. 5 is a block diagram illustrating a control circuit controlling a cleaning operation (an absorption operation) in the ink jet printing apparatus IJ according to the embodiment, and the like. As shown in FIG. 5, one end of the tube member 20 constituting the tube pump 10 communicates with the capping portion 13, and the other end communicates with a waste ink tank 23. Accordingly, the waste ink discharged to the inner space of the capping portion 13 can be removed to the waste ink tank 23 through the tube pump 10.

Reference Numeral 30 in FIG. 5 denotes a host computer, and the host computer 30 is provided with a printer driver 31. Using utilities of the printer driver 31, data such as the existing sheet sizes, selection of printing modes, and fonts, and printing instructions are input using an input device and a display.

Printing data is transmitted from the printer driver 31 to a printing control unit 32, and the printing control unit 32 generates bitmap data on the basis of the received printing data and generates a driving signal by a head driving unit 33 on the basis of the bitmap data to eject ink from the printing head 12.

The head driving unit 33 receives a flushing instruction signal from a flushing control unit 35 constituting a part of the cleaning control unit 34 in addition to the driving signal based on the printing data, and outputs a driving signal for flushing to the printing head 12.

The cleaning control unit 34 further includes an ink absorption control unit 36, and the ink absorption control unit 36 controls driving of the tube pump 10 when performing ink absorption as the cleaning operation. The cleaning control unit 34 switches a sealed state and a non-sealed state of the nozzle formed face 12*a* of the printing head 12 by capping portion 13. A carriage driving control unit 37 moves the carriage 1 to a predetermined position on the basis of the driving signal from the printing control unit 32 and the cleaning control unit 34.

For example, the cleaning control unit 34 performs a real absorption operation of rolling the roller member 21 in a predetermined direction in a state where the capping portion 13 covers the nozzle formed face 12*a*, and an idle absorption operation of rolling the roller member 21 in the same direction in a state where the capping portion 13 does not cover the nozzle formed face 12*a*.

The real absorption operation is an operation of absorbing a space between the capping portion 13 and the nozzle formed face 12*a* in the state where the capping portion 13 covers the nozzle formed face 12*a*. For example, ink is discharged from the nozzle formed area 12*a* by the real absorption operation. For example, the cleaning control unit 34 performs the real absorption operation many times in one cleaning operation.

The idle absorption operation is an operation of absorbing a space between the capping portion 13 and the nozzle formed area 12*a* in the state where the capping portion 13 does not cover the nozzle formed face 12*a*. The idle absorption operation includes a plurality of unit absorption steps of rolling the roller member 21 by a predetermined angle. For example, the step is a mode used in a case of absorbing and removing ink in the capping portion 13. Of course, the idle absorption may be performed in a state where ink does not exist in the capping portion 13. For example, the cleaning control unit 34 sets the number of performed unit absorption steps to set the amount of absorption in the idle absorption operation and to adjust the position of the roller member 21.

Next, an operation of the ink jet printing apparatus IJ configured as described above will be described. In the following description, the cleaning operation using the tube pump 10 will be mainly described. In the embodiment, in one cleaning operation, the real absorption operation is performed, for example, three times. In one real absorption operation, the roller member 21 is rolled, for example, clockwise by 180°. In the embodiment, in each of the plurality of real absorption operations and each of the plurality of idle absorption operations, the movement direction of the roller member 21 is the same direction (clockwise rotation).

Cleaning Operation 1

Figure 6:
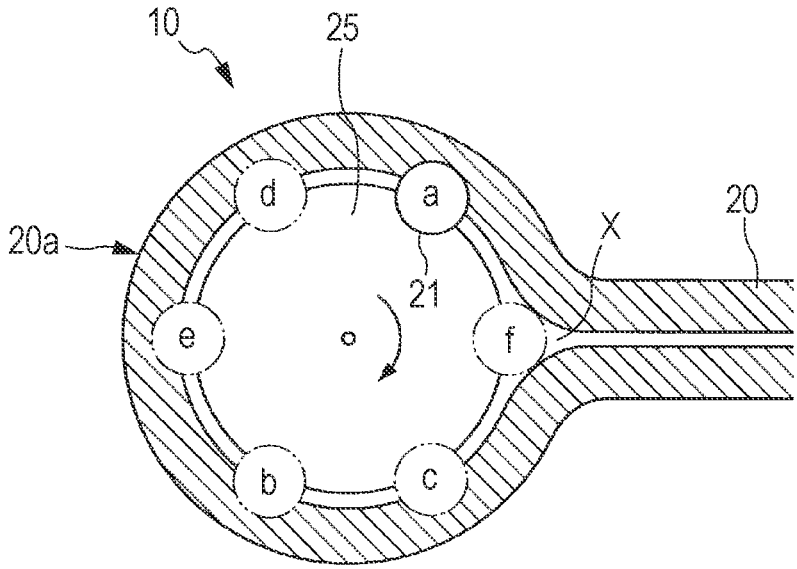
FIG. 6 is a process diagram illustrating an operation of the ink jet printing apparatus.

The cleaning control unit 34 allows the nozzle formed face 12*a* of the printing head 12 and the capping portion 13 to be opposed to each other, and then allows the nozzle formed face 12*a* to be airtight by the capping portion 13. In this case, as shown in FIG. 6, for example, the roller member 21 of the tube pump 10 is positioned at a position a.

From this state, the cleaning control unit 34 rolls the roller member 21 by, for example, 180°, to perform the first real absorption operation. As a result, the roller member 21 is moved clockwise to a position b shown in FIG. 6.

Then, the cleaning control unit 34 removes the capping portion 13 from the nozzle formed face 12*a* once, to perform the idle absorption operation. In this operation, for example, the number of performed steps of the unit absorption steps of the idle absorption operation is adjusted to move the roller member 21 clockwise from the position b to the position c. The position c is a starting position of the second real absorption operation.

Hereinafter, the position c will be described. The position c is a position deviating from the position a clockwise by 120°. The position a is the starting position of the roller member 21 in the first real absorption operation. For this reason, the starting position (the position c) of the second real absorption operation is set to a position deviating from the starting position (the position a) of the first real absorption operation in the rolling direction by 120°. Accordingly, the cleaning control unit 34 rolls the roller member 21 from the position b clockwise by 300° (180°+120°).

Then, the cleaning control unit 34 makes the nozzle formed face 12*a* airtight by the capping portion 13, and then rolls the roller member 21 from the position c by, for example, 180° to perform the second real absorption operation. As a result, the roller member 21 is moved clockwise to the position d shown in FIG. 6.

Then, the cleaning control unit 34 removes the capping portion 13 from the nozzle formed face 12*a* again to perform the idle absorption operation. In this operation, the roller member 21 is moved clockwise from the position d to the position e. The position e is the starting position of the third real absorption operation, and is a position deviating from the position c clockwise by 120°.

Then, the cleaning control unit 34 makes the nozzle formed face 12*a* airtight by the capping portion 13, and then rolls the roller member 21 from the position e by, for example, 180° to perform the third real absorption operation. As a result, the roller member 21 is moved clockwise to the position f shown in FIG. 6.

Then, the cleaning control unit 34 removes the capping portion 13 from the nozzle formed face 12*a* again to perform the idle absorption operation. In this operation, the roller member 21 is moved clockwise from the position f to the position a. The position a is the starting position of the first real absorption operation in a series of cleaning operations, and is a position deviating from the position e clockwise by 120°. By the above-described operation, the first cleaning operation is completed.

Hereinafter, the movement of the roller member 21 in the cleaning operation will be described. The roller member 21 is moved by 180° in the first real absorption operation, and is moved by 300° in the later idle absorption operation. The roller member 21 is moved by 180° in the second real absorption operation, and is moved by 300° in the later idle absorption operation. The roller member 21 is moved by 180° in the third real absorption operation, and is moved by 300° in the later idle absorption operation. As described above, the roller member 21 repeats the movement of 180° in the real absorption operation and the movement of 300° in the later idle absorption operation.

In each of the first real absorption operation, the second real absorption operation, and the third absorption operation, the starting position of the roller member 21 is moved to the position a, the position c, and the position e clockwise by 120° at a time. In the one cleaning operation, a rolling ending position of the roller member 21 is the position a. For this reason, in the next cleaning operation, the roller member 21 starts rolling from the position a again.

Cleaning Operation 2

Figure 7:
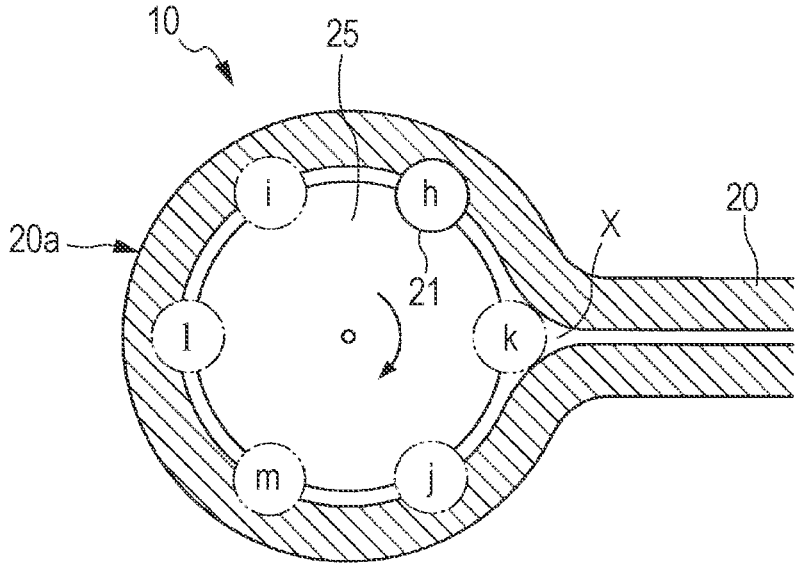
FIG. 7 is a process diagram illustrating an operation of the ink jet printing apparatus.

Next, a case of performing the idle absorption operation before performing each real absorption operation will be described. In this case, the cleaning control unit 34 allows the nozzle formed face 12*a* of the printing head 12 and the capping portion 13 to be opposed to each other, and then allows the capping portion 13 and the nozzle formed face 12*a* to be separated from each other. In this case, as shown in FIG. 7, for example, the roller member 21 of the tube pump 10 is positioned at a position h.

The cleaning control unit 34 first performs the idle absorption operation from the state where the roller member 21 is at the position h. In this idle absorption operation, the cleaning control unit 34 rolls the roller member 21 from the position h to the position i clockwise by 300°. Thereafter, the cleaning control unit 34 makes the nozzle formed face 12*a* airtight by the capping portion 13, and then performs the first real absorption operation. In this operation, the cleaning control unit 34 rolls the roller member 21 from the position i to the position j clockwise by 180°.

Then, the cleaning control unit 34 removes the capping portion 13 from the nozzle formed face 12*a* once to perform the idle absorption operation. In this operation, the roller member 21 is moved clockwise from the position j to the position k clockwise by 300°.

Thereafter, the cleaning control unit 34 makes the nozzle formed face 12*a* airtight by the capping portion 13, and then performs the second real absorption operation. In this operation, the cleaning control unit 34 rolls the roller member 21 from the position k to the position l clockwise by 180°.

Then, the cleaning control unit 34 removes the capping portion 13 from the nozzle formed face 12*a* again to perform the idle absorption operation. In this operation, the cleaning control unit 34 moves the roller member 21 clockwise from the position l to the position m clockwise by 300°.

Then, the cleaning control unit 34 makes the nozzle formed face 12*a* airtight by the capping portion 13, and then performs the third real absorption operation. In this operation, the cleaning control unit 34 rolls the roller member 21 from the position l to the position h clockwise by 180°. By the above-described operations, the first cleaning operation is completed.

When the idle absorption operation is firstly performed, the position i becomes the starting position of the roller member 21 for performing the first real absorption operation, the position k becomes the starting position of the roller member 21 in the second real absorption operation, and the position m becomes the starting position of the roller member 21 in the third real absorption operation. As described above, even when the idle absorption operation is firstly performed, the starting position of the roller member 21 is moved to the position h, the position j, and the position l clockwise by 120° at a time. In the one cleaning operation, the rolling ending position of the roller member 21 is the position h. For this reason, the roller member 21 starts rolling (the idle absorption operation) from the position h again.

In the embodiment, in two kinds of cleaning operations, the case where the real absorption operations in one cleaning operation are performed three times has been described by way of example, but the invention is not limited thereto, and the invention may be applied even when the number of real absorption operations is twice or less and four times or more.

Specifically, when the number of real absorption operations is three times, the position of the roller member 21 is adjusted such that the starting position of the roller member 21 when performing each real absorption operation moves clockwise by 120° at a time. Accordingly, when three real absorption operations are completed, it is possible to return the roller member 21 to the original position (the position at the time of starting the cleaning operation). Since the next cleaning operation can be performed in the same state as the previous cleaning operation, it is possible to make the amount of absorption for each cleaning operation uniform.

From this, considering a case of performing the real absorption operation n times (n is a natural number of 2 or more), when each real absorption operation is performed, it is preferable to adjust the starting position such that the starting position of the roller member 21 is moved, for example, clockwise by (360/n)° at a time. That is, it is preferable to satisfy at least one of:

rolling angle of roller member 21 by real absorption operation+rolling angle of roller member 21 by idle absorption operation=$m\times360°\pm(360/n)°$ (1)

rolling angle of roller member 21 by idle absorption operation+rolling angle of roller member 21 by next real absorption operation=$m\times360°\pm(360/n)°$, where $m$ is a natural number. (2)

In this case, n real absorption operations are completed, and the roller member 21 is in a state of returning to the starting position of the cleaning operation. Accordingly, when the real absorption operation is performed many times, it is possible to make the amount of absorption during the other cleaning operation uniform. Since the starting position of the roller member 21 is dispersed to the whole of the ring-shaped portion 20*a* of the tube member 20, non-uniformity of the amount of absorption is reduced.

As described above, according to the embodiment, when the real absorption operation is performed many times as the cleaning operation, the idle absorption operation is performed on at least one side before and after each real absorption operation to adjust the starting position of the roller member 21 when performing the real absorption operation, and thus it is possible to adjust the starting position of the roller member 21 without detecting the phase of the roller member 21. Accordingly, it is possible to suppress the non-uniformity of the amount of absorption for each cleaning operation without making the configuration of the apparatus complex, for example, without providing the tube pump 10 with a phase detecting device or the like.

According to the embodiment, in each of the plurality of real absorption operations and the plurality of idle absorption operations, the roller member 21 is rolled in the same rolling direction (e.g., clockwise), and thus it is possible to easily adjust the starting position of the roller member 21. In this case, it is preferable that the capping portion 13 is provided with an air opening mechanism different from the tube pump 10.

According to the embodiment, since the starting position of the roller member 21 is shifted in the rolling direction by the same angle whenever the real absorption operation is performed, it is possible to disperse the starting position of the roller member 21 to the whole of the ring-shaped portion 20*a* of the tube member 20. Accordingly, during one whole cleaning operation, the non-uniformity of the amount of absorption hardly occurs.

Since the roller member 21 is returned to the initial position (the position at the starting time of cleaning) when one cleaning operation is completed, it is possible to make the position of the roller member 21 regular when performing the cleaning. Accordingly, it is possible to suppress the non-uniformity of the amount of absorption during the maintenance operation.

Generally, in the tube pump, a position where the flexible tube 50 cannot be structurally pressed by the roller member 51, that is, a leak point exists. When the roller member 51 is stopped at the leak point, leakage of fluid may occur in the tube pump. Specifically, in the tube pump shown in FIG. 8A, a part X of binding the flexible tubes 50 is the leak point.

Figure 8A:
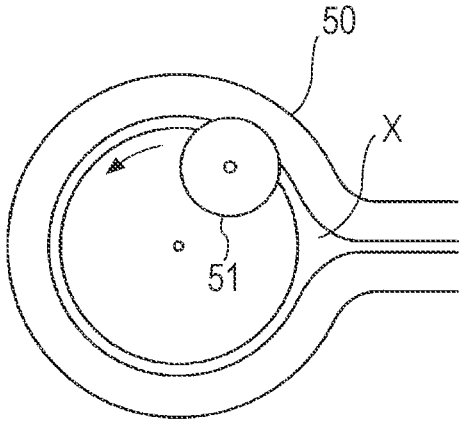
FIG. 8A, FIG. 8B, and FIG. 8C are diagrams illustrating characteristics of the tube pump in the ink jet printing apparatus.
Figure 8B:
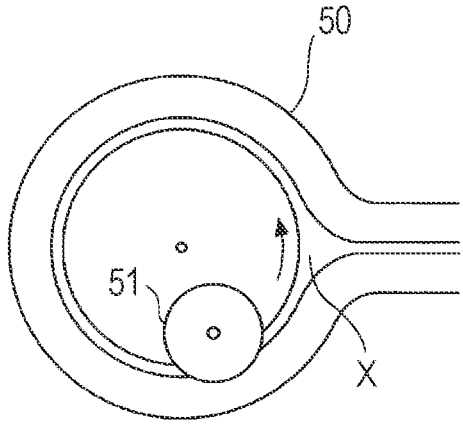

At the time of starting the absorption operation, as shown in FIG. 8A, when the roller member 51 is started from a position far away from the leak point X, a distance from the starting position to the leak point X is long, and thus the amount of absorption increases. Meanwhile, as shown in FIG. 8B, when the roller member 51 is started from a position close to the leak point X, the roller member 51 reaches the leak point X at the time point when some negative pressure occurs after starting rotation, the negative pressure decreases due to the leak at that position, and thus the amount of absorption decreases.

Figure 8C:
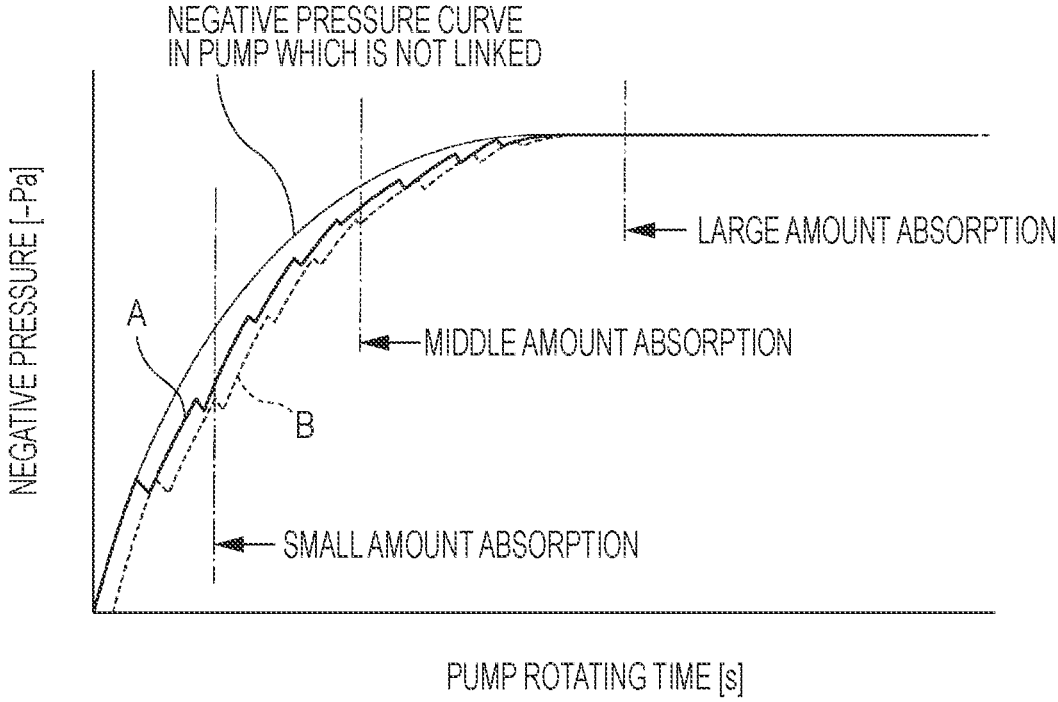

FIG. 8C is a graph illustrating the relation between a pump rotation time [seconds] and a negative pressure [−Pa]. In FIG. 8C, Reference Sign A denotes a negative pressure curve when starting the absorption operation from the state shown in FIG. 8A, and Reference Sign B denotes a negative pressure curve when starting the absorption operation from the state shown in FIG. 8B. In the graph shown in FIG. 8C, a negative pressure curve in a pump having no leak point is shown for comparison.

As can be seen from FIG. 8C, even in any of the case A and the case B, the negative pressure decreases at the time point when the roller member 51 reaches the leak point X, and thus the amount of absorption decreases as compared with the pump having no leak point. A degree of decrease of the amount of absorption caused by the leak at the leak point X in the case B (FIG. 8B) is larger than that in the case A (FIG. 8A).

As described above, in the tube pump having the leak point X, the starting position of the roller member 51 is changed, and thus the non-uniformity occurs in the real amount of absorption. When a set value of the amount of absorption is small, non-uniformity of about ±30% occurs, and when the set value of the amount of absorption is middle, non-uniformity of about ±10% occurs. On the contrary, in the embodiment, even when the tube pump 10 including the leak point X is used, it is possible to suppress the non-uniformity of the amount of absorption for each cleaning operation.

The technical scope of the invention is not limited to the embodiment, and may be appropriately modified within the scope which does not deviate from the purpose of the invention.

Figure 9:
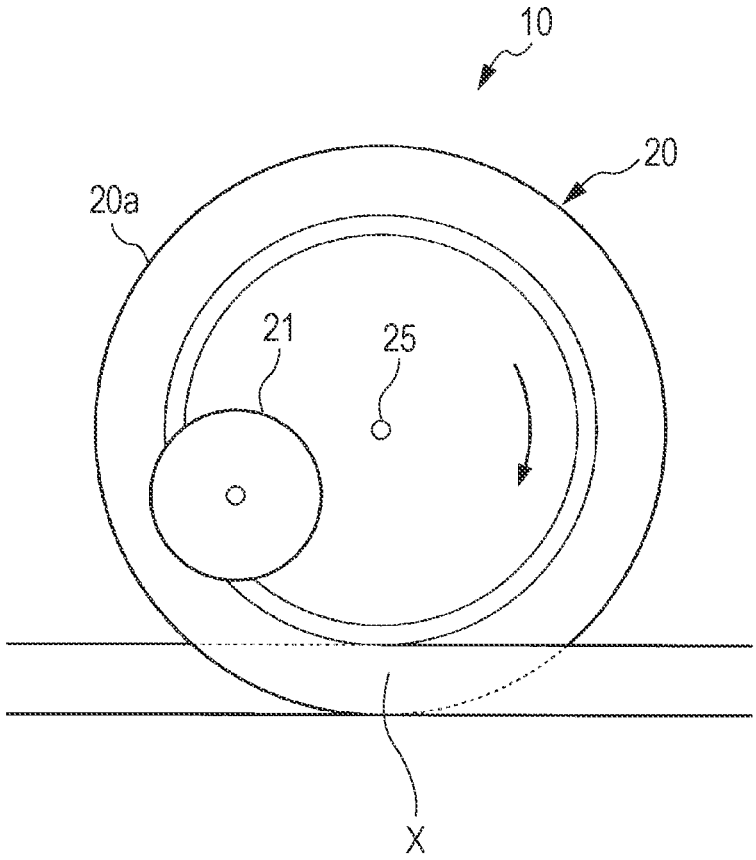
FIG. 9 is a diagram illustrating another example of the tube pump in the ink jet printing apparatus.

For example, in the embodiment, as the tube pump 10, the structure of the tube pump is a configuration of taking out both ends of the tube member 20 in the same direction and controlling both ends, for example, on the same plane, but is not limited thereto. For example, as shown in FIG. 9, the invention can be applied to a case of a tube pump using a structure of taking out and intersecting ends of a tube member 20 curved in a ring shape in a reverse direction with each other. In this case, a part where the ends of the tube member 20 intersect each other is the leak point X.

In the embodiment, when the idle absorption operation is performed, the number of unit absorption steps performed by the cleaning control unit 34 is set to adjust the starting position, but the invention is not limited thereto, and the starting position may be adjusted on the basis of other elements.

In the embodiment, when the real absorption operation and the idle absorption operation are performed in the cleaning operation, for example, the roller member 21 is rolled in one direction (e.g., clockwise), but in practice, the invention is not limited thereto. As necessary, the roller member 21 may be rolled in the reverse direction (e.g., counterclockwise).

What is claimed is:

1. A fluid ejecting apparatus comprising:

an ejection head that has an ejection face to eject fluid;

a cap portion that covers the ejection face of the ejection head;

a tube pump that includes a tube member connected to the cap portion and having a curved portion with flexibility and a roller member rolling in an inner circumference of the curved portion while pressing and deforming the tube member, to change pressure of a space at the cap portion by the rolling of the roller member; and a control device that drives the tube pump, in one maintenance operation, when a real absorption operation of rolling the roller member is performed many times in a state where the cap portion covers the ejection face, to adjust a starting position of the roller member when performing the real absorption operation by performing an idle absorption operation of rolling the roller member in a state where the fluid is not discharged from the ejection face of the ejection head on at least one side before and after each real absorption operation.

2. The fluid ejecting apparatus according to claim 1, wherein the control device shifts the starting position in a rolling direction of the roller member by the same angle whenever the real absorption operation is performed.

3. The fluid ejecting apparatus according to claim 2, wherein the control device rolls the roller member in the same rolling direction in the real absorption operation and the idle absorption operation.

4. The fluid ejecting apparatus according to claim 3, wherein the control device allows a position of the roller member when the last absorption operation in the one maintenance operation is completed, to coincide with the starting position of the first absorption operation in the one maintenance operation.

5. The fluid ejecting apparatus according to claim 4, wherein the curved portion include a leak portion in which the amount of deformation caused by the pressing of the roller member is insufficient.

6. A method of maintaining a fluid ejecting apparatus including:

an ejection head that has an ejection face to eject fluid;

a cap portion that covers the ejection face of the ejection head; and a tube pump that includes a tube member connected to the cap portion and having a curved portion with flexibility and a roller member rolling in an inner circumference of the curved portion while pressing and deforming the tube member, to change pressure of a space at the cap portion by the rolling of the roller member, wherein, as one maintenance operation, when a real absorption operation of rolling the roller member is performed many times in a state where the cap portion covers the ejection face, a starting position of the roller member when performing the real absorption operation is adjusted by performing an idle absorption operation of rolling the roller member in a state where the cap portion does not cover the ejection face on at least one side before and after each real absorption operation.

7. The method of maintaining the fluid ejecting apparatus according to claim 6, wherein the maintenance operation includes a cleaning operation of the ejection head.

8. A method of driving a tube pump that includes a tube member that is connected to a cap portion covering an ejection face of an ejecting head ejecting fluid and has a curved portion with flexibility and a roller member rolling in an inner circumference of the curved portion while pressing and deforming the tube member, to change pressure of a space at the cap portion by the rolling of the roller member, wherein, as one maintenance operation for the ejection head, when a real absorption operation of rolling the roller member is performed many times in a state where the cap portion covers the ejection face, a starting position of the roller member when performing the real absorption operation is adjusted by performing an idle absorption operation of rolling the roller member in a state where the fluid is not discharged from the ejection face of the ejection head on at least one side before and after each real absorption operation.

9. The fluid ejecting apparatus according to claim 1, further comprising an air opening mechanism provided under the cap portion at a position different from that of the tube pump.

10. The fluid ejecting apparatus according to claim 1, wherein the state where the fluid is not discharged from the ejection face of the ejection head is also a state where the cap portion does not cover the ejection face.

* * * * *